US008322557B2

(12) United States Patent
Sele et al.

(10) Patent No.: US 8,322,557 B2
(45) Date of Patent: Dec. 4, 2012

(54) TANK STRUCTURE

(75) Inventors: Arne Sele, Hosle (NO); Kare Bakken, Aros (NO)

(73) Assignee: Aker Engineering & Technology AS, Lysaker (NO)

( * ) Notice: Subject to any disclaimer, the term of this patent is extended or adjusted under 35 U.S.C. 154(b) by 478 days.

(21) Appl. No.: 12/527,616

(22) PCT Filed: Feb. 20, 2008

(86) PCT No.: PCT/NO2008/000065

§ 371 (c)(1),
(2), (4) Date: Nov. 25, 2009

(87) PCT Pub. No.: WO2008/103053

PCT Pub. Date: Aug. 28, 2008

(65) Prior Publication Data

US 2010/0084407 A1 Apr. 8, 2010

(30) Foreign Application Priority Data

Feb. 20, 2007 (NO) ..... 20070958

(51) Int. Cl.

| | |
|---|---|
| ***B65D 90/02*** | (2006.01) |
| ***B65D 1/42*** | (2006.01) |
| ***B65D 6/34*** | (2006.01) |
| ***B65D 8/08*** | (2006.01) |
| ***F17C 1/00*** | (2006.01) |

(52) U.S. Cl. ..... 220/560.1; 220/560.05; 220/560.07; 220/585; 220/651; 220/652

(58) Field of Classification Search ..... 220/560.05, 220/560.07, 560.1, 560.12, 565, 651, 652, 220/653

See application file for complete search history.

(56) References Cited

U.S. PATENT DOCUMENTS

| | | | | |
|---|---|---|---|---|
| 3,472,414 | A | 10/1969 | Rodrigues | |
| 2007/0194051 | A1 * | 8/2007 | Bakken et al. | 222/173 |

FOREIGN PATENT DOCUMENTS

| | | | |
|---|---|---|---|
| EP | 0298181 | | 7/1987 |
| FR | 1591601 | A | 5/1970 |
| WO | WO 2006/001711 | A2 | 1/2006 |

OTHER PUBLICATIONS

International Search Report of the International Search Authority PCT/NO2008/000065, Dated May 9, 2008.

* cited by examiner

*Primary Examiner* — Anthony Stashick
*Assistant Examiner* — Madison L Poos
(74) *Attorney, Agent, or Firm* — Myers Bigel Sibley & Sajovec

(57) ABSTRACT

A prismatic tank has outer and inner walls and internal horizontal stays. The walls include a plurality of horizontal beam sections. Each beam section has two parallel flanges interconnected by a web and a pair of opposing end faces. The beam sections are stacked one on top of the other and joined together along adjoining longitudinal edges of respective flanges and at end faces of respective beam sections such that a joint is formed between a first end face of a first beam section and a second, abutting end face of a second, abutting beam section. The web of the first beam section is recessed at the first end face and the web of the second beam section is recessed at the second end face so as to leave a first opening in the joint.

14 Claims, 5 Drawing Sheets

TANK STRUCTURE

RELATED APPLICATIONS

This application claims priority from International PCT Application No. PCT/NO2008/000065, filed on Aug. 20, 2008, which claims priority from Norwegian Patent Application No. 20070958, filed Feb. 20, 2007, the disclosures of each of which are incorporated herein by reference in their entireties.

FIELD OF THE INVENTION

The present invention relates to tanks for storage and transportation of fluids such as hydrocarbons, including low temperature liquefied natural gas. This includes tanks for ships, for gravity base and floating offshore structures, and for land-based installations.

BACKGROUND OF THE INVENTION

Tanks may be designed in many different configurations, such as spheres, cylinders, cones and shells in general, as well as prismatic shapes. The principle advantage of prismatic shapes is that they nest close to each other, minimising the volume taken up by such tanks. Simple prismatic tanks are far less efficient structurally as they rely on bending action for mobilisation of strength. Shells develop strength through direct tension in the plane of the shell. This develops greater strength for the same amount of material.

A more efficient design of prismatic shapes is to incorporate internal stays (tension beams). By developing tension as the main means of restraining the internal load or pressure, such prismatic staid tanks are comparable to shell shapes in structural efficiency. WO 2006/001711 A2 discloses such tanks and is hereby incorporated by reference.

Apart from having sufficient strength to restrain yielding, the tank structure must also be designed to prevent crack propagation as a consequence of fatigue. The principle concern of such structures is crack propagation at weld locations, as opposed to locations in base metal where crack propagation will progress very slowly or even be arrested.

OBJECT OF THE INVENTION

The object of the present invention is to design a double barrier tank such that all connections between the two barriers are base metal without local stress raisers, to ensure that fatigue cracks do not propagate from one liquid barrier to the other.

SUMMARY OF THE INVENTION

The object of the present invention is obtained by a prismatic tank.

The more common way of joining a continuity of beam sections to foam a tank wall is to place the joints between the beams close to the inflection points where the axial stresses in the flanges are zero and the shear load is modest. However, in the present invention the joints between the beam sections are placed at the connecting points of the internal stays. In the beam joints, only the flanges of the beams are connected to each other and not the webs. Instead, the webs are recessed in a smooth curve, so that the end faces of the recessed webs form an opening with a rounded contour. Thus, there will be no weld or other connection between the end faces of the webs, thereby avoiding stress concentrations and material changes susceptible to fatigue crack propagation. The reduction in shear strength caused by the opening may be counteracted by a stiffening bracket applied to the inner wall of the tank generally in the plane of the web. These brackets may suitably be made to attach the internal stays of the tank to the double wall.

BRIEF DESCRIPTION OF THE DRAWINGS

Further details of the invention will be described below with reference to the exemplifying embodiments shown schematically in the appended drawings, wherein.

DETAILED DESCRIPTION OF THE DRAWINGS

Figure 1:
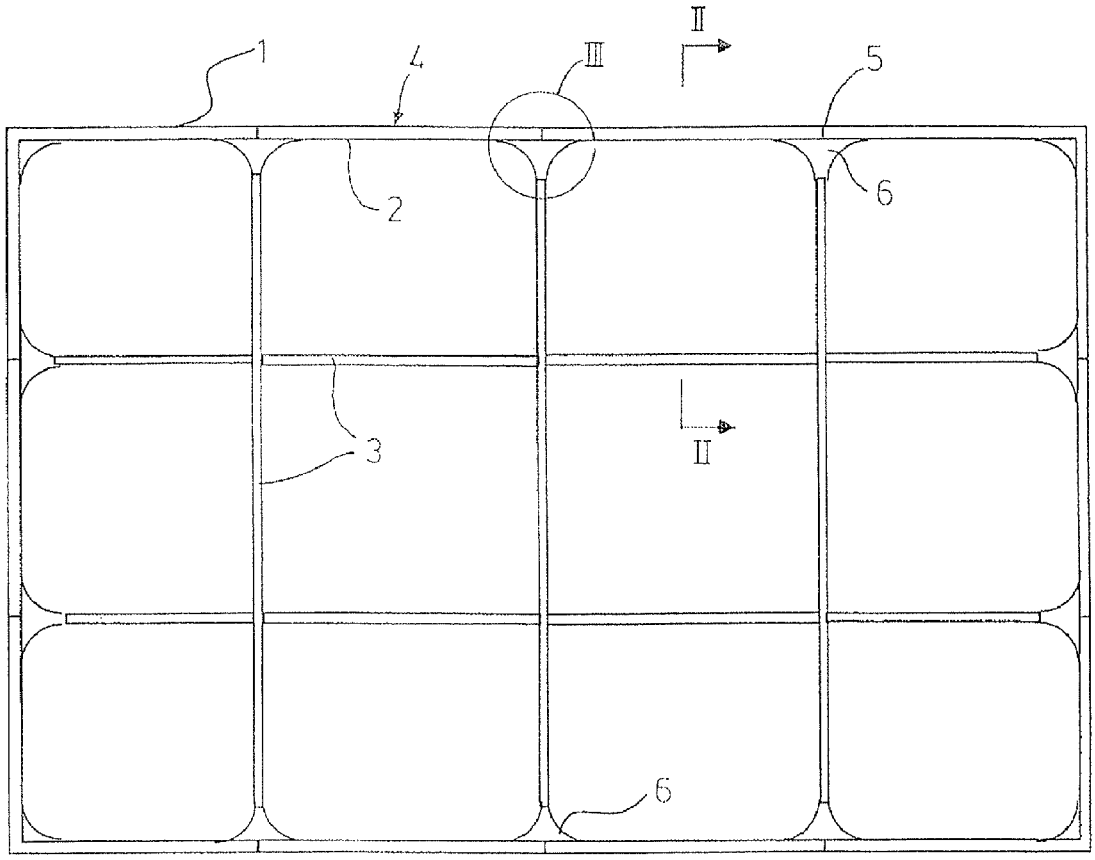
FIG. 1 shows a plan view of a prismatic double-walled tank with the roof removed.

FIG. 1 shows a plan view of a double containment having an outer wall 1, an inner wall 2, and internal stays 3 connecting opposite walls of the tank. The tank walls are established by welding together horizontal beam sections 4 having a cross-section in the shape of an H, the beam sections 4 being stacked one on top of the other and joined together along their adjoining longitudinal edges and at their end faces abutting other end faces of beam sections 4 or connecting pieces, as indicated by 5 in FIG. 1. The stays 3 are connected to the respective walls at the joint 5 locations by means of brackets 6. It will be understood that the stays 3 substantially reduce bulging of the tank walls when subjected to internal pressure from the fluid contained therein. Additionally, the stays 3 in effect form perforated "bulkheads" reducing cargo movement, known as sloshing, when the tank is a cargo tank in a ship which is rolling and pitching on its journey.

Figure 2:
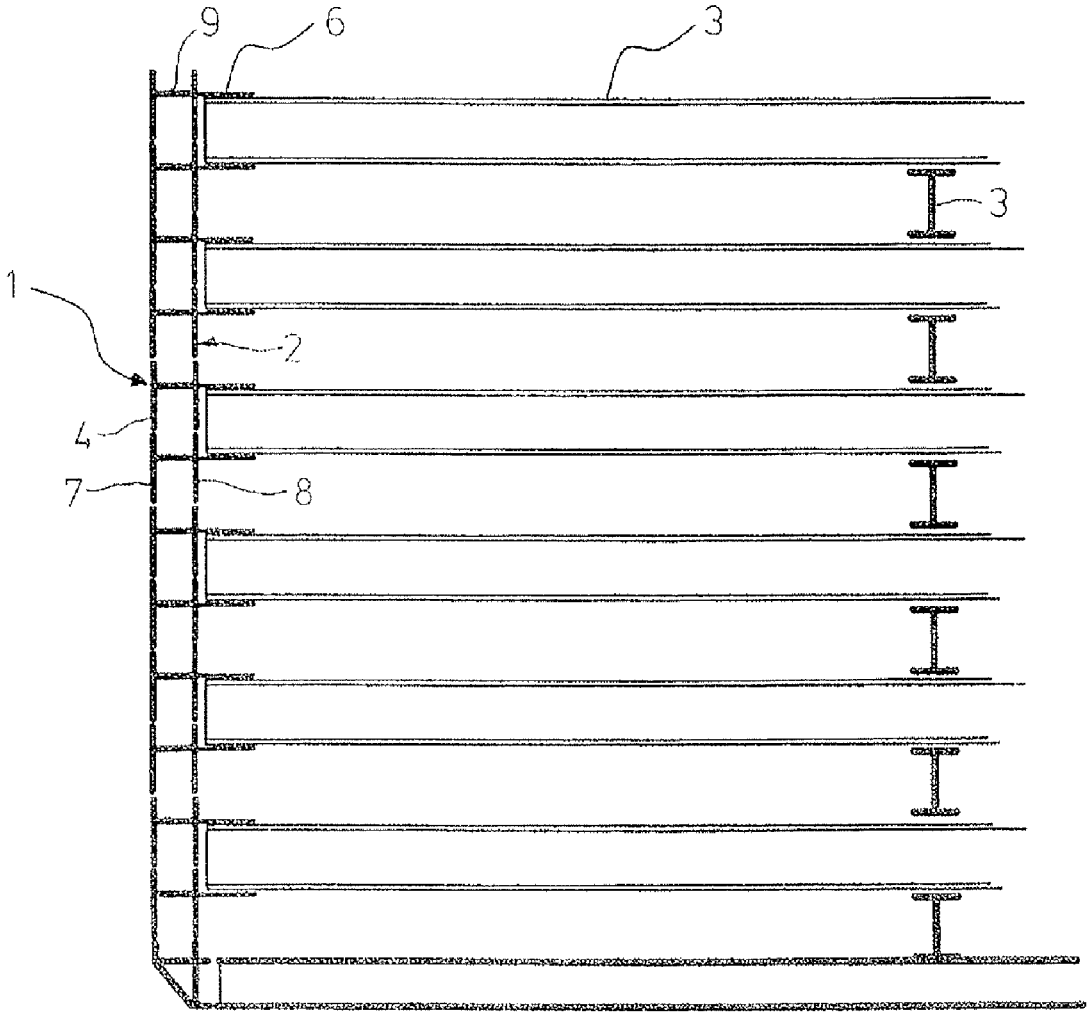
FIG. 2 show a sectional view taken along the line II-II in FIG. 1.

FIG. 2 shows a cross-section through part of the bottom and a side wall of the tank in FIG. 1. FIG. 2 shows how H-beam sections 4 are stacked one on top of the other, their parallel flanges 7, 8 forming the outer and inner walls 1, 2 of the double-walled tank. The flanges 7, 8 of the beam sections are joined by a horizontal web 9, as will be more clearly seen in FIG. 4. The brackets 6 connecting the stays 3 to the inner wall 2 are aligned with the web 9 so as to form an extension of the web on the inner side of the tank, thus transferring the tensile load from the respective stay 3 in the area of the beam section 4 where it can best handle such a load.

Figure 3:
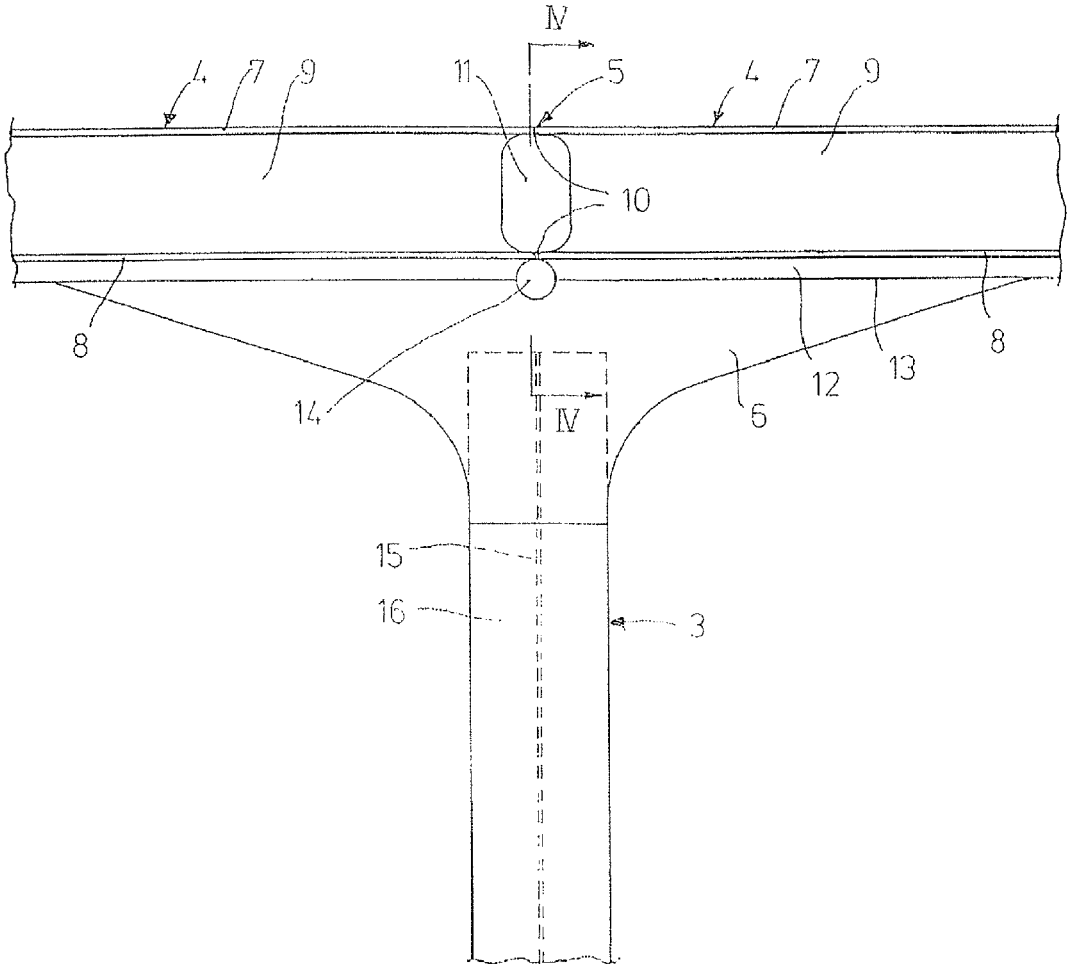
FIG. 3 shows at a larger scale the detail indicated by III in FIG. 1.

FIG. 3 shows an enlargement of the area circled and labelled III in FIG. 1. This plan view shows two beam sections 4 welded together at their outer and inner flanges 7, 8 by welds 10. In this area, the webs 9 of the beam sections have been recessed so as to form a first opening 11 having a smooth and rounded contour. Thus, there is no weld extending between the flanges 7, 8 in the area of the joint 5.

Figure 4:
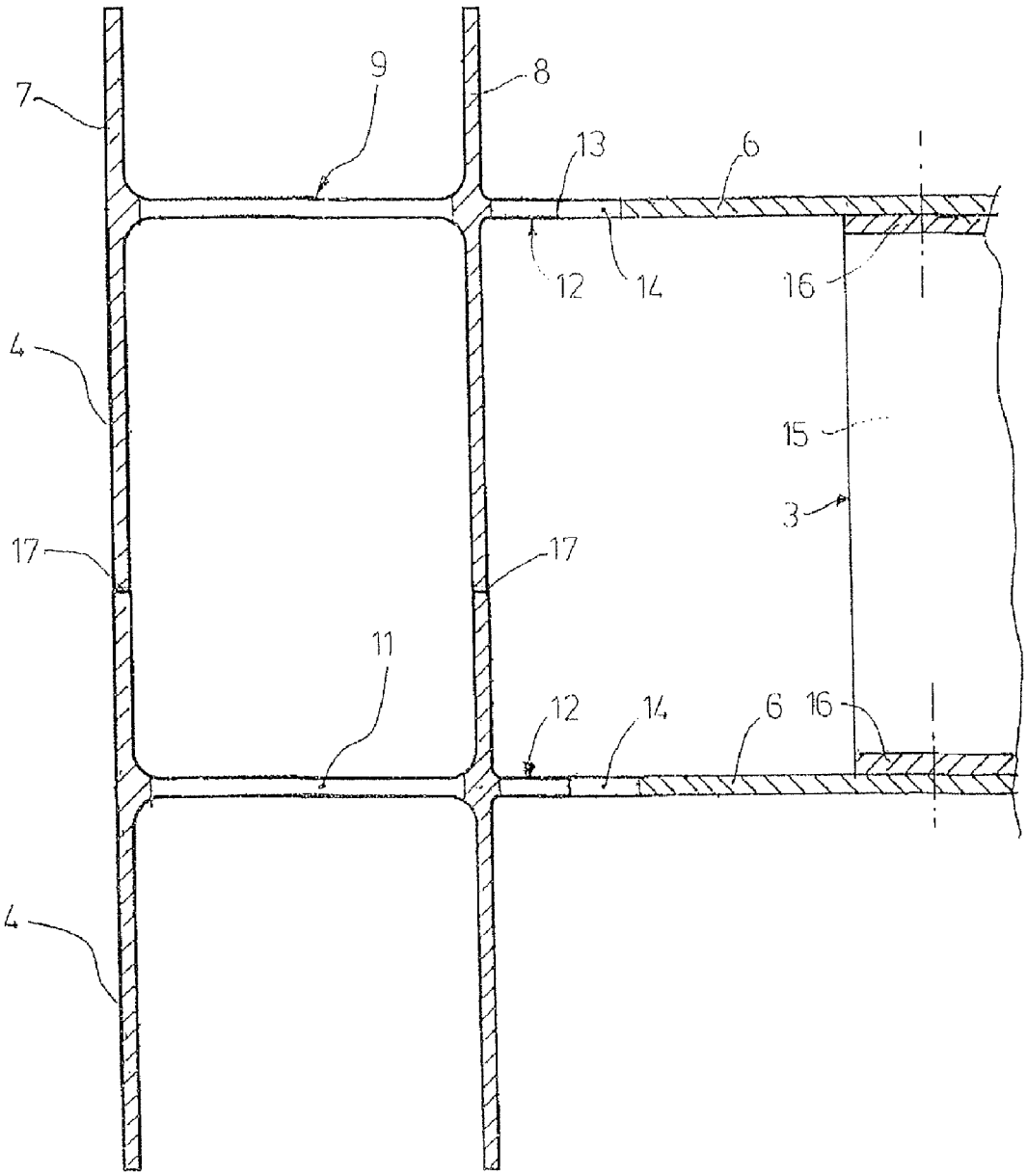
FIG. 4 shows at a larger scale a sectional view along the line IV-IV in FIG. 3.

FIG. 3 also shows that the beam section 4 is provided with a longitudinal rib 12 which, as will be better seen in FIG. 4, is located on the inner flange 8 as an extension of the web 9. The bracket 6 is welded at 13 to the rib 12 and extends in a smoothly tapering form at a substantial distance on either side of the area of the joint 5. The bracket 6 will therefore ensure that the discontinuity of the webs 9 in the joint 5 area does not impair the strength of the joint. The shape of the bracket 6 also ensures that cracks will not form at its free edge when cyclic loads are transferred from the stay 3. Also, to avoid crack formation and propagation in the area of the inner weld 10, a second opening 14 is made in the rib 12 and bracket 6 adjacent to this weld.

The bracket 6 is preferably welded to the rib 12 before the stay 3 is attached to the bracket. Furthermore, if expedient from a manufacturing point of view, the bracket 6 may be divided into two symmetrical parts, each being welded to the respective beam section 4 before the beam sections are joined at the joint 5, whereupon the bracket parts are welded together before being attached to the stay 3. The stay may be attached to the bracket 6 by means (not shown), e.g. for both on either side of the web 15 of the stay. This will cause the force between the stay 3 and bracket 6 to be taken up mainly as a friction force created in the contact area between the bracket 6 and the respective flange 16 of the stay 3 (FIG. 2 will show that the stays 3 are I-beams).

An enlarged cross-section taken along line IV-IV in FIG. 3 is shown in FIG. 4. This view may also be taken as an enlargement of the upper left hand corner of the tank shown in FIG. 2.

The figure shows two beam sections 4 joined together along adjoining longitudinal edges of the outer and inner flanges 7, 8 by welds 17. The webs 9 extending between the flanges 7, 8 will be recognised, as also the openings 11 made in the webs. On the inner side of the inner flange 8, the rib 12 will be seen as an extension of the respective web 9, as will the weld 13 between the rib 12 and respective bracket 6. Furthermore, the second opening 14 is also shown.

FIG. 4 further shows the end of the stay 3 fixed between two brackets 6 by means of bolts, hear indicated only by their centre line. It is noted that the stay 3 is terminated at a distance from the inner flanges 8 which is about five times the width of the rib 12, while the radius of the second opening 14 is about equal to the width of the rib. Thus, this opening 14 also avoids a stress concentration in the weld 13.

FIG. 4 shows the relative dimensions of the various component parts taken from an actual LNG ship tank about 30 metres high. The thickness of the flanges, webs and ribs both for the beam sections 4 and stay 3 is 10-12 mm, the width of the flanges 7, 8 is 400 mm and the span between them is 270 mm. The web is located eccentrically between the edges of the flanges 7, 8, the shorter distance from the web 9 to the nearest flange edge being about half the longer distance to the other flange edge. This will place the weld 17 near an inflection point in the inner wall 2 when it is subjected to a hydrostatic pressure from the cargo. From this point of view, the eccentricity of the flange could have been even larger, but the present shorter distance between the web 9 and weld 17 has been chosen in this manner in order to provide sufficient room for performing the weld 17, which preferably is made by friction stir welding.

Figure 5:
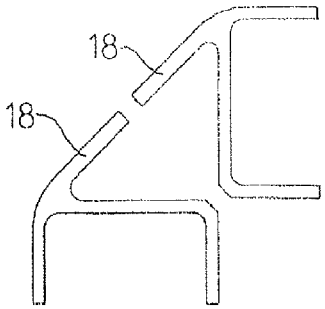
FIG. 5 shows an end view of two beam sections before being joined to a connecting piece as shown in the bottom left corner of FIG. 2.
Figure 6:
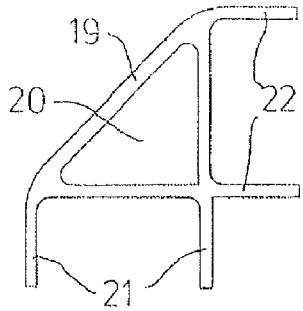
FIG. 6 shows an end view of the beam sections of FIG. 5 joined together.

According to the purpose of the present invention, it is also important to avoid stress concentrations and fatigue crack propagation at the corners of the tank. A simple mitre joint where the flanges and webs of the beam sections are welded together, would therefore not be satisfactory. Consequently, the invention suggests special connection pieces or beams for such purposes. FIG. 5 shows two identical beam sections 18 placed so as to form a symmetrical arrangement before being welded together to form the transition piece 19 shown in FIG. 6. The beam sections 18 are made of extruded aluminium material, and the reason for welding two such beams together instead of extruding the transition piece 19 directly, is that extruding a beam having a hollow triangular portion 20, here shaped like a right-angled triangle, is very difficult. The small sides of the hollow triangular portion 20 have parallel legs 21, 22 extending therefrom, the spacing between said legs being equal to the width of the web 9 of the beam sections 4.

Figure 7:
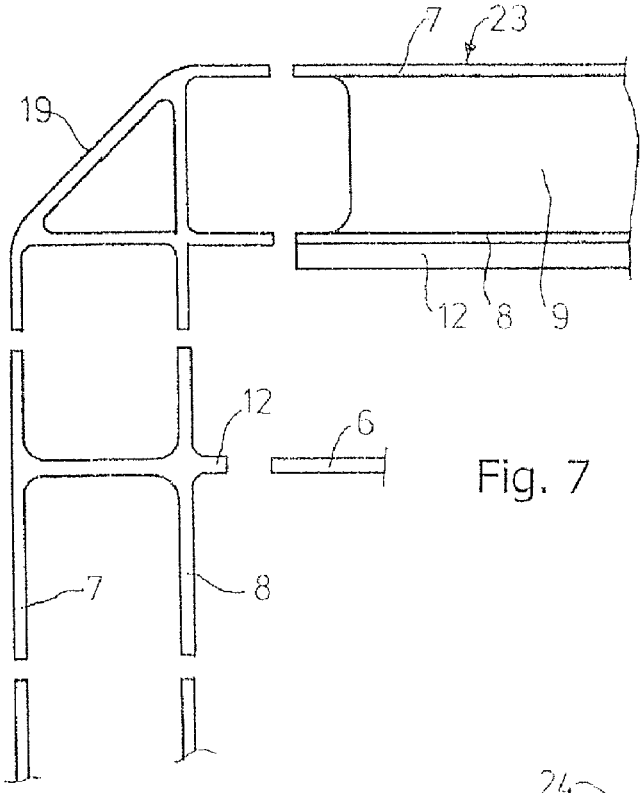
FIG. 7 shows schematically the connecting piece of FIG. 6 in forming the corner between a wall of the tank and its roof.

FIG. 7 shows how the transition piece 19 enters into a corner between a side wall and the roof 23 of the tank. Here, the roof is made up by beam sections identical to the beam sections 4 of the walls of the tank. Again, the web 9 is recessed away from the weld area.

Figure 8:
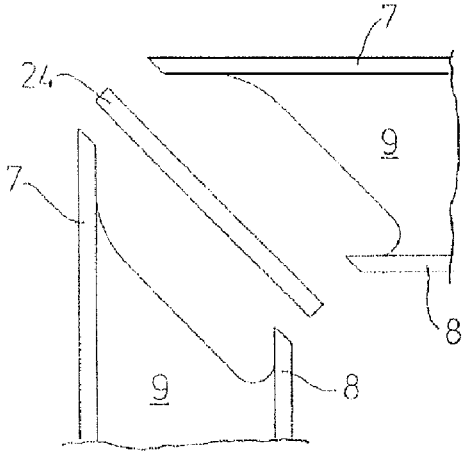
FIG. 8 illustrates schematically how a corner between two walls of the tank may be formed.

FIG. 8 suggests a simpler corner solution, which is particularly suited for vertical corners between side walls of the tank. This is basically a mitre joint, but the webs 9 of the beam sections 4 have been recessed as in other joints between the beams, and the weakening caused by such recessing is counteracted by placing a flat plate 24 between the end faces of the flanges 7, 8 to be joined together.

It will be understood that the invention is not limited to the exemplifying embodiments shown in the drawings and described above, but that it may be modified and varied within the scope of the appended claims. Thus, means of joining tank element other than welding and bolting may be used, such as gluing or riveting. Furthermore, to reduce the detrimental effect of minor dimensional differences or slight warping of the beam sections at their end faces to be joined, a transition piece, e.g. in the form of an I-beam section, may be inserted between said faces. In such cases, a second opening should be introduced in the weld areas on either side of the I-beam section.

The invention claimed is:

1. A prismatic tank having outer and inner walls and internal horizontal stays restraining a force exerted on said walls by fluid contained in the tank, said walls comprising a plurality of horizontal beam sections, each beam section having two parallel flanges interconnected by a web and a pair of opposing end faces, wherein the beam sections are stacked one on top of the other and joined together along adjoining longitudinal edges of respective flanges and at end faces of respective beam sections such that a joint is formed between a first end face of a first beam section and a second, abutting end face of a second, abutting beam section, wherein the web of the first beam section is recessed at the first end face and the web of the second beam section is recessed at the second end face so as to leave a first opening in the joint.

2. A tank according to claim 1, wherein said first opening has a rounded contour.

3. A tank according to claim 1, wherein at least a plurality of said stays are each connected to the inner wall at a location of a joint between abutting beam section end faces by at least one bracket extending to either side of said joint.

4. A tank according to claim 3, wherein a second opening is formed in the bracket adjacent to said joint.

5. A tank according to claim 4, wherein at least some of said beam sections each have a rib arranged as an external extension of the web, said bracket being connected to said rib and said second opening extending into said rib.

6. A tank according to claim 3, each stay being connected to said at least one bracket at a distance from said inner wall.

7. A tank according to claim 1, wherein the web of at least some of said beam sections is located eccentrically with respect to the longitudinal edges of the flanges of the beam sections.

8. A tank according to claim 7, wherein the web of at least some of the beam sections is located near an inflection point of the flange defining the inner wall when subjected to a hydrostatic pressure from fluid contained in the tank.

9. A tank according to claim 1, the tank further comprising corners, wherein each corner of the tank comprises a corner piece configured to connect to an end face of one of the beam sections to form a joint, wherein the web at the end face of the beam section has a recess, thereby forming an opening in the joint.

10. A tank according to claim 9, wherein each corner piece comprises a hollow portion shaped like a right-angled triangle having a base and two small sides, and parallel legs extending perpendicularly from ends of the small sides of the triangle.

11. A tank according to claim 10, wherein the corner piece is formed by two symmetrical parts welded together at the corner of the small sides and a middle of the base of the triangle.

12. A tank according to claim 9, wherein a pair of beam sections are joined in a corner in a mitre joint, the corner piece being a flat plate to which the flanges of the beam sections are welded, the webs of the beam sections being recessed away from said flat plate.

13. A tank according to claim 9, wherein the corner pieces are configured to transfer forces and bending moments when connected to beam sections.

14. A tank according to claim 1, wherein the internal horizontal stays are I-beams.

* * * * *